US006561146B2

(12) United States Patent
Todd et al.

(10) Patent No.: US 6,561,146 B2
(45) Date of Patent: May 13, 2003

(54) METHOD OF CONTROLLING RESONANCES IN INTERNAL COMBUSTION ENGINE HAVING VARIABLE CAM TIMING

(75) Inventors: Kevin Todd, Freeville, NY (US); Braman Wing, Interlaken, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 09/915,143

(22) Filed: Jul. 25, 2001

(65) Prior Publication Data

US 2003/0019447 A1 Jan. 30, 2003

(51) Int. Cl.[7] ..... F01L 1/34

(52) U.S. Cl. ..... 123/90.15; 123/90.17; 123/90.31

(58) Field of Search ..... 123/90.15, 90.17, 123/90.12, 90.31, 90.11; 474/110, 111

(56) References Cited

U.S. PATENT DOCUMENTS 4,614,170 A * 9/1986 Pischinger et al. ..... 123/90.11
4,844,022 A * 7/1989 Konno ..... 123/198 F
4,858,572 A 8/1989 Shiral et al. ..... 123/90.12
5,031,585 A 7/1991 Muir et al. ..... 123/90.17
5,065,709 A * 11/1991 Ito et al. ..... 123/90.15
5,117,785 A 6/1992 Suga et al. ..... 123/90.17
5,172,659 A 12/1992 Buttfferfield et al. .... 123/90.17
5,899,181 A * 5/1999 Kurata et al. ..... 123/508
5,937,806 A * 8/1999 Lyko et al. ..... 123/90.15
6,053,138 A 4/2000 Trzmiel et al. ..... 123/90.17
6,250,265 B1 6/2001 Simpson ..... 123/90.17

* cited by examiner

*Primary Examiner*—Thomas Denion
*Assistant Examiner*—Jaime Corrigan
(74) *Attorney, Agent, or Firm*—Brown & Michaels, PC; Greg Dziegielewski

(57) ABSTRACT

A method of controlling resonances in timing drive systems for internal combustion engines having variable cam timing systems using cam phasers with the capability of being locked in position. Locking or unlocking the phaser changes the resonant characteristics of the timing drive system. The invention uses these changes in characteristics between locked and unlocked phasers to minimize the effects of resonance in timing drives by changing between locked and unlocked states as engine RPM passes through resonant points.

7 Claims, 2 Drawing Sheets

METHOD OF CONTROLLING RESONANCES IN INTERNAL COMBUSTION ENGINE HAVING VARIABLE CAM TIMING

BACKGROUND OF THE INVENTION

1. Field of the Invention

The invention pertains to the field of variable cam timing systems. More particularly, the invention pertains to variable cam timing systems of the kind having phasers for varying the radial disposition of a camshaft relative to its drive means (sprocket or drive gear).

2. Description of Related Art

Traditionally, the camshaft (or, in a multiple camshaft engine, camshafts) of an internal combustion engine, which actuates the intake and/or exhaust valves, is connected to the crankshaft, which receives the force from the pistons, by a timing chain, belt or gear arrangement driving sprockets, pulleys or gears, respectively, on the ends of the shafts. The relative timing of the camshaft(s) and crankshaft in such a system is fixed, and must be chosen to be tailored to power or economy at a given engine speed or load condition. This is inherently a compromise, as an automobile engine does not, obviously, always run at the same speed or load, and a given car owner might desire either power or economy at different times. The demands of emissions control complicate matters further.

This has given rise to Variable Cam Timing (VCT) systems, where the timing of the valves relative to the crankshaft can be changed by altering the relative rotational positions of the camshaft(s) and crankshaft. One of the more successful systems for VCT involves using a device called a "phaser" to allow the camshaft sprocket, which is linked to the crankshaft by the timing chain, to shift angular position relative to the end of the camshaft. Typically, the phaser is a coaxial arrangement of an outer housing which forms the sprocket (or pulley or gear) and an inner rotor fixed to the camshaft. The angular position of the rotor and housing can be shifted by fluid pressure acting on pistons or vanes on the rotor inside cylinders or chambers formed in the housing.

The "vane phaser" setup is commonly used in VCT systems, and will be used in the examples in this disclosure, although it will be understood that the method of the invention will work with other forms of phasers known to the art. Butterfield and Smith, U.S. Pat. No. 5,172,659, "Differential Pressure Control System for Variable Camshaft Timing System", assigned to BorgWarner Inc., shows a vane phaser system which uses the inherent torque reversals in the camshaft caused by the actuation of the valves to move the vane from one position to another. Fluid is led from one side of each vane to the opposing side through a valve. When the valve is open, the rotor is free to oscillate, the fluid passing freely from one side of the vane to the other. When the valve is closed, the fluid cannot flow, and the vane is held in position. By opening the valve while the torque reversal is acting to move the camshaft in the desired direction, then closing the valve, the camshaft is allowed to move, then held in place by the fluid on each side of the vane.

A number of U.S. patents show phasers which have mechanical locking mechanisms. The locking of the phaser is most often provided to prevent unwanted phase shifts during periods of high torque reversals, when the actuating force of the phaser is not sufficient to hold the selected timing, as during engine start-up, when engine oil pressure is low, reducing the available pressure to activate the phaser, the oil in the phaser may have leaked away, and the erratic engine operation can lead to dramatic forces on the cam. The following patents show different means of locking a phaser in place.

Simpson, U.S. Pat. No. 6,250,265 "Variable Valve Timing With Actuator Locking for Internal Combustion Engine", assigned to BorgWarner Inc, shows a vane-type phaser with a locking mechanism which is released by engine oil pressure, so as to lock the phaser when engine oil pressure is low.

Trzmiel, et. al, U.S. Pat. No. 6,053,138, "Device for Hydraulic Rotational Angle Adjustment of a Shaft Relative to a Drive Wheel", assigned to Porsche AG and Hydraulik Ring GmbH, also uses a hydraulic brake arrangement.

Muir et. al, U.S. Pat. No. 5,031,585, "Electromagnetic Brake for a Camshaft Phase Change Device", assigned to Eaton Corporation, uses an electromagnetic clutch to lock the phaser.

Suga, et. al, U.S. Pat. No. 5,117,785, "Valve Timing Control Device for Internal Combustion Engine", assigned to Atsugi Unisia Corporation, uses a cam or wedge locking system.

All mechanical systems have one or more resonant frequencies, where the characteristics of the system change, sometimes abruptly, with the frequency of actuation. In the case of a valve timing system for an internal combustion engine, the resonant frequencies of the camshaft, crankshaft and timing chain/belt/gears will all combine into a complex set of reactions which can lead to excessive noise or vibration at specific engine RPM.

SUMMARY OF THE INVENTION

If an engine is fitted with a VCT phaser, the resonant characteristics of the timing system will change, depending on whether the phaser is locked (i.e. the rotor and housing are acting as a unit) or unlocked (the rotor and housing can rotate independently to some extent). The method of the invention uses this alteration in characteristics to minimize the effects of resonance, by locking or unlocking the phaser as a resonant point in the engine RPM is approached.

DETAILED DESCRIPTION OF THE INVENTION

Figure 3:
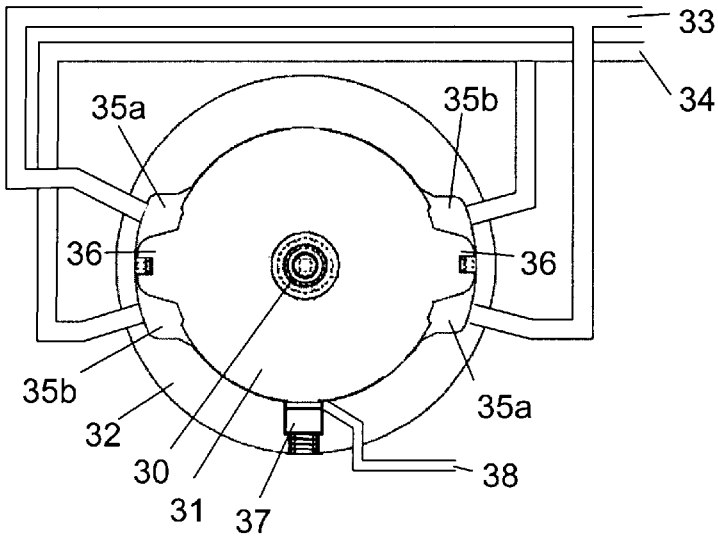
FIG. 3 shows a schematic representation of an example of a cam phaser which could be used with the method of the invention.

As shown in FIG. 3, a vane-type cam phaser for a Variable Cam Timing (VCT) system has a housing (32), which connects to the timing drive (belt, chain or gears—not shown), and a rotor (31), which connects to the camshaft (30) of the engine. The vanes (36) of the rotor (31) can move within arcuate recesses in the housing (32), which are divided into two chambers (35*a*)(35*b*). Introducing a fluid (engine oil) into chambers (35*a*) through line (33) while draining fluid from chambers (35*b*) through line (34) rotates the rotor (31) counterclockwise relative to the housing (32), thus advancing (for example) the timing of the camshaft (30) relative to the crankshaft (not shown). Similarly, introducing the oil into chambers (35*b*) through line (34) while draining fluid from chambers (35*a*) through line (33) rotates the rotor (31) clockwise relative to the housing (32), thus retarding (for example) the timing of the camshaft (30) relative to the crankshaft (not shown).

The phaser in FIG. 3 is equipped with a lock mechanism, shown as a piston (37) in the housing (32), which is normally pressed against the rotor (31) to lock it, but can be unlocked by introduction of oil under pressure into line (38). When the piston (37) presses against the rotor (31), the rotor (31) and housing (32) are constrained to rotate together, which will be termed "locked" in this description. When the oil pressure releases the piston (37), the rotor (31) and housing (32) are free to rotate relative to one another under the control of the fluid pressure in lines (33) and (34) (within the limits set by the size of the chambers, of course), and this is termed "unlocked".

It will be understood that the method of the invention requires only that there be a cam phaser which has a locking system. No particular phaser design or locking system is required by the invention, and the piston arrangement and vane phaser shown in FIG. 3 is for the purposes of example and explanation only.

The forces on the timing drive can be affected by the cam phaser in a number of ways. The crankshaft-timing drive (chain)-phaser-camshaft system can be thought of as a spring system. The spring system has one inertia characteristic when the drive and camshaft are rigidly connected (i.e. phaser locked), and a lower inertia characteristic when they are connected hydraulically (i.e. phaser unlocked).

When the device is locked, it has a similar stiffness to a fixed timing drive, but with several times the inertia of a conventional cam drive (sprocket, pulley, or gear). In addition to the increase in inertia, the cam phaser adds a great deal of viscous damping and compliance to the system. These characteristics change when the cam phaser is unlocked.

It will be understood that while the examples below show effects of fully locking or fully unlocking the cam phaser, for the purposes of the method of the invention, the terms "locked" and "unlocked" include both binary systems in which the lock either rigidly clamps the rotor and housing together or leaves them completely free, or continuous systems in which the locking mechanism permits intermediate conditions which increase the friction between the rotor and housing without completely fastening them together. What is required by the method is a locking mechanism which changes the compliance condition—i.e. friction or locked status—between the timing drive and the camshaft (between the rotor and the housing, in the vane phaser system as shown in FIG. 3).

Figure 1A:
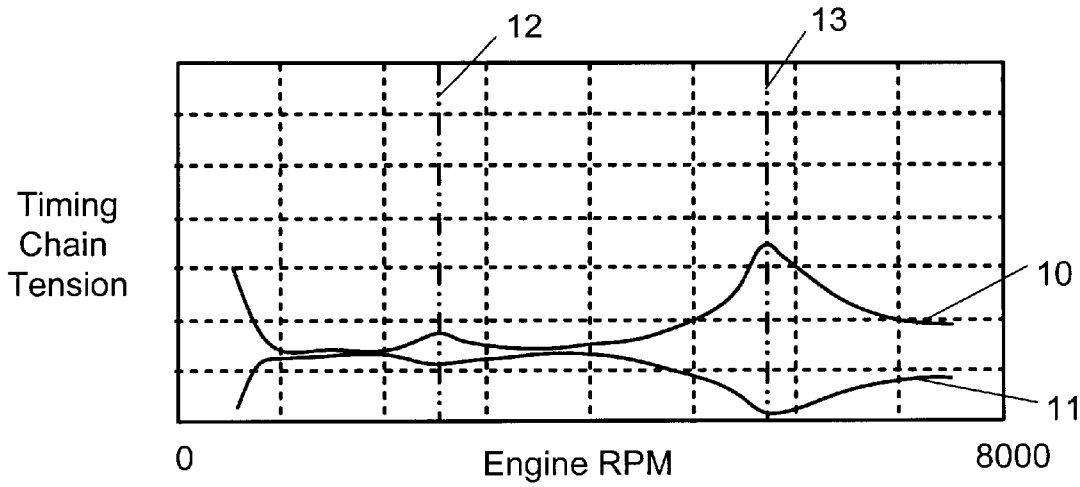
FIG. 1*a* shows a graph of timing chain tension vs. engine RPM for a first representative engine, with the cam phaser locked.
Figure 1B:
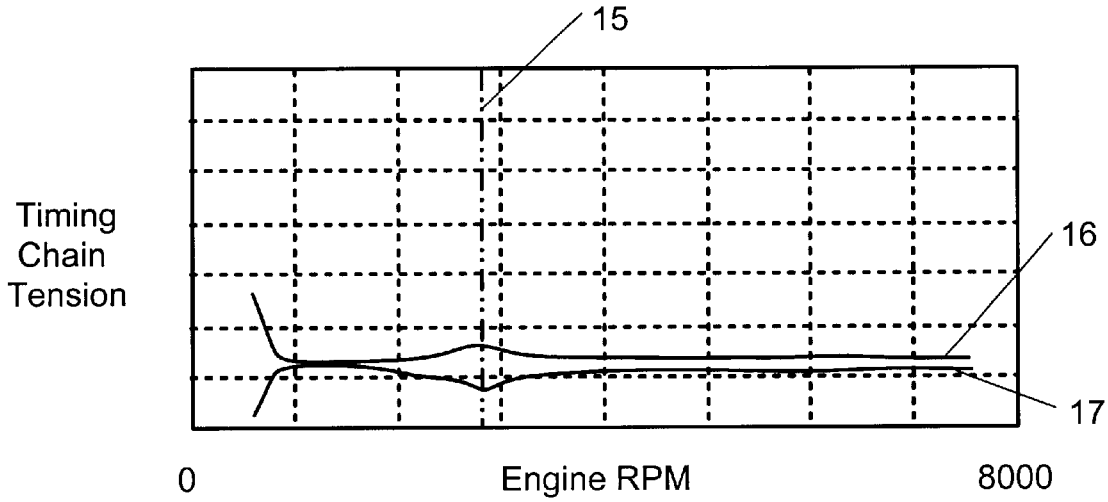
FIG. 1*b* shows a graph of timing chain tension vs. engine RPM for a first representative engine, with the cam phaser unlocked.
Figure 2A:
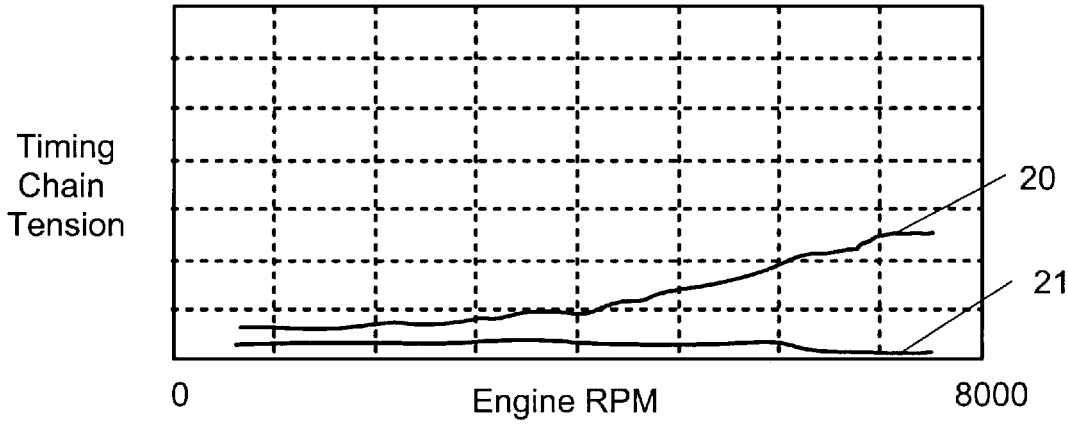
FIG. 2*a* shows a graph of timing chain tension vs. engine RPM for a second representative engine, with the cam phaser locked.

The method of the invention comprises using these changes in characteristics due to compliance conditions in the phaser to minimize the effects of resonance in timing drives by changing between locked and unlocked states (or some condition between) as engine RPM passes through resonant points. FIGS. 1*a* and 1*b*, and 2*a* and *b*, illustrate some of these effects.

FIGS. 1*a* and 1*b* show graphs of timing chain tension (vertical axis) vs. engine RPM (horizontal axis) in the primary chain of a representative V6 equipped with a VCT system. FIG. 1*a* shows how maximum (10) and minimum (11) tensions vary with the phaser locked as the engine speed increases between approximately 700 and 7500 RPM. As can be seen, resonances cause peaks in the maximum (10) and dips in the minimum (11) lines at approximately 2500 RPM (12) and 5700 RPM (13). This would result in vibration and noise, and possibly additional stress and wear on the timing drive, when the engine is run at these speeds. With the phaser unlocked (FIG. 1*b*), the 5700 RPM resonance disappears, and the 2500 RPM resonance shifts (15) to approximately 2800 RPM.

Using the method of the invention with the engine of this example, the phaser would be locked at low RPM, then unlocked as engine RPM approached 2500 RPM (12), then locked again when the engine reached 2800 RPM (15). As engine speed increases, the phaser would once again be unlocked above a selected RPM of approximately 4500 RPM, where the minimum (11) and maximum (10) tension curves begin to diverge.

Figure 2B:
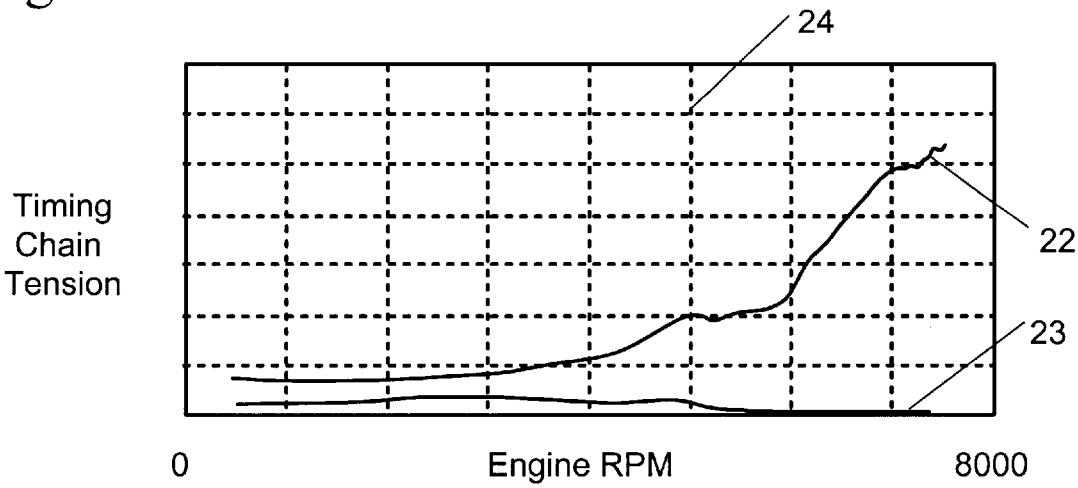
FIG. 2*b* shows a graph of timing chain tension vs. engine RPM for a second representative engine, with the cam phaser unlocked.

FIGS. 2*a* and 2*b* show resonance effects in another, very different, example engine—a four-cylinder engine equipped with a VCT system. This engine shows effects which require the method of the invention to choose the opposite at high RPM of the V6. In this example, it can be seen that the minimum (23) and maximum (22) tension lines with the phaser unlocked (FIG. 2*b*) diverge widely as the engine RPM exceeds about 5000 RPM (24). With the phaser locked (FIG. 2*a*), however, the minimum (21) and maximum (20) torques remain much closer together as the RPM increases.

Thus, in the engine of FIGS. 2*a* and 2*b*, the phaser would be unlocked at lower RPM, then locked as the RPM passes a selected point above approximately 5000 RPM (24), where the resonance effects change.

Thus, it can be seen that the method of the invention is performed by:

1. Recording the timing drive forces over a range of engine RPM, both with the phaser locked and with the phaser unlocked.
2. Analyzing the recorded timing drive forces to identify resonance effects.
3. While the engine is operating, choosing the locked or unlocked status of the phaser at a given RPM to minimize effects of resonance identified in step 2.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of minimizing resonance effects in a cam timing drive system of an internal combustion engine having a camshaft and a crankshaft, a camshaft, a variable cam timing device coupled to the camshaft, and a cam timing drive system coupling the crankshaft and the variable cam timing device, the variable cam timing device comprising a cam phaser having a variable compliance condition between the cam timing drive system and the camshaft, the cam timing drive system showing resonant changes in timing drive forces over a range of engine RPM, the changes in timing drive forces being different with the cam phaser in the locked condition and with the cam phaser in the unlocked condition; comprising the step of while the engine is operating, choosing a condition of the cam phaser at a given RPM to minimize effects of resonance.

2. The method of claim 1, further comprising the steps of:

a) recording the timing drive forces over a range of engine RPM, both with the cam phaser in the locked condition and with the cam phaser in the unlocked condition; and b) analyzing the recorded timing drive forces to identify resonance effects.

3. The method of claim 1, in which the compliance condition of the cam phaser can be varied continuously between fully locked and fully unlocked.

4. The method of claim 1, in which the compliance condition of the cam phaser can be either fully locked or fully unlocked.

5. A method of minimizing resonance effects in a cam timing drive system of an internal combustion engine having a camshaft and a crankshaft, a camshaft, a variable cam timing device coupled to the camshaft, and a cam timing drive system coupling the crankshaft and the variable cam timing device, the variable cam timing device comprising a cam phaser having a variable compliance condition between the cam timing drive system and the camshaft, comprising the steps of:

a) recording the timing drive forces over a range of engine RPM, both with the cam phaser in the locked condition and with the cam phaser in the unlocked condition;

b) analyzing the recorded timing drive forces to identify resonance effects; and c) while the engine is operating, choosing the locked condition or unlocked condition of the cam phaser at a given RPM to minimize effects of resonance identified in step b.

6. The method of claim 5, in which the compliance condition of the cam phaser can be varied continuously between fully locked and fully unlocked.

7. The method of claim 5, in which the compliance condition of the cam phaser can be either fully locked or fully unlocked.

* * * * *